United States Patent [19]

Nelson et al.

[11] 3,991,562

[45] Nov. 16, 1976

[54] COMBUSTION CHAMBER ASSEMBLY HAVING REMOVABLE CENTER LINER

[75] Inventors: James C. Nelson, East Hartford; Bertus Ooms, Coventry, both of Conn.

[73] Assignee: United Technologies Corporation, Hartford, Conn.

[22] Filed: July 21, 1975

[21] Appl. No.: 597,877

[52] U.S. Cl. ..... 60/39.65; 60/39.69; 431/352

[51] Int. Cl.[2] ..... F02C 7/22

[58] Field of Search ..... 60/39.69, 39.37, 39.31, 60/39.65, 39.71; 431/352; 415/219 R, 201

[56] References Cited

UNITED STATES PATENTS

| | | | |
|---|---|---|---|
| 2,446,059 | 7/1948 | Peterson et al. | 60/39.65 X |
| 2,609,664 | 9/1952 | Staley | 60/39.37 |
| 2,778,192 | 1/1957 | Kroon | 60/39.65 X |
| 2,852,914 | 9/1958 | Robin et al. | 60/39.32 X |
| 2,951,339 | 9/1960 | Benson | 60/39.65 |
| 2,982,098 | 5/1961 | Vickert | 60/39.71 |

*Primary Examiner*—Carlton R. Croyle
*Assistant Examiner*—Thomas I. Ross
*Attorney, Agent, or Firm*—Vernon F. Hauschild

[57] ABSTRACT

The combustion section of the gas turbine is comprised of an engine casing receiving compressor discharge air and housing a plurality of combustion chamber assemblies having removable inner center liners. The combustion chamber assemblies are comprised of an outer liner having an end wall in which fuel injectors are mounted and the removable inner center liner extending within the outer liner from the end wall to define an annular combustion chamber space adjacent the end wall.

11 Claims, 9 Drawing Figures

COMBUSTION CHAMBER ASSEMBLY HAVING REMOVABLE CENTER LINER

BACKGROUND OF THE INVENTION

The present invention relates to combustors of the type used in gas turbine engines or the like and, more particularly, is concerned with a combustion chamber assembly having a center liner which is removable from the engine independently of the remaining portions of the assembly.

Gas turbine engines and the like which are utilized as stationary or vehicular power plants require less frequent inspections and overhauls and less maintenance than the older types of power sources such as piston engines. Nevertheless, these engines have many critical points which must be periodically inspected or replaced during the lifetime of the engine. The need for inspecting components such as the combustion chamber assemblies is particularly important since these assemblies are subjected to wide temperature variations and temperature extremes that impose severe stress and cause progressive deterioration.

Some prior art combustion assemblies such as shown in U.S. Pat. No. 2,778,192 issued to P. J. Kroon are made for complete removal from the associated engine and for sectional replacement after the assembly has been removed. Complete removal of the combustion assembly, of course, also entails removal of the fuel injection system which may be time consuming especially if an inspection of the combustion assembly is all that is required.

Accordingly, it is a general object of the present invention to provide a combustion chamber assembly having an outer burner can liner which supports the fuel injection components and an inner center liner which is removable for inspecting the combustion components such as the outer liner and other nearby elements such as transition ducts and stator or rotor vanes over which the combustion gases pass in the first stage of the turbine.

SUMMARY OF THE INVENTION

The present invention resides in a combustion chamber assembly for gas turbine engines or the like having a combustion chamber formed by an outer liner and a removable inner center liner.

The outer combustion chamber liner is formed from a perforated shell and defines a central axis of the combustion chamber together with upstream and downstream axial ends of the chamber. The shell is open at the downstream end in order to expel combustion gases from the chamber. The upstream end of the chamber is defined by an end wall of the outer liner bearing a central opening concentric with the central chamber axis and a plurality of circumaxially spaced openings for receiving fuel injection nozzles.

The removable inner liner like the outer liner is formed from a perforated shell to admit air into the center of the combustion chamber. The inner liner extends into the outer liner along the central chamber axis from the central opening in the upstream end wall. The perforated shell forming the inner liner is inserted and removed from the outer liner through the central opening and, when inserted, the inner liner mates closely with the central opening to form an annular combustion chamber space adjacent the end wall and between the inner and outer liners. It is this space into which fuel is injected for combustion with air entering the chamber through both of the perforated shells forming the two liners.

By constructing the combustion chamber assembly so that the inner center liner can be removed from the outer liner while the outer liner remains in the engine, inspections of the combustion chamber including the center liner, the fuel injection nozzles and the first stage rotor or stator vanes of a turbine driven by the combustion gases are greatly simplified, and replacement of the center liner itself may also be accomplished with ease.

DESCRIPTION OF THE PREFERRED EMBODIMENTS

Figures 1, 2:
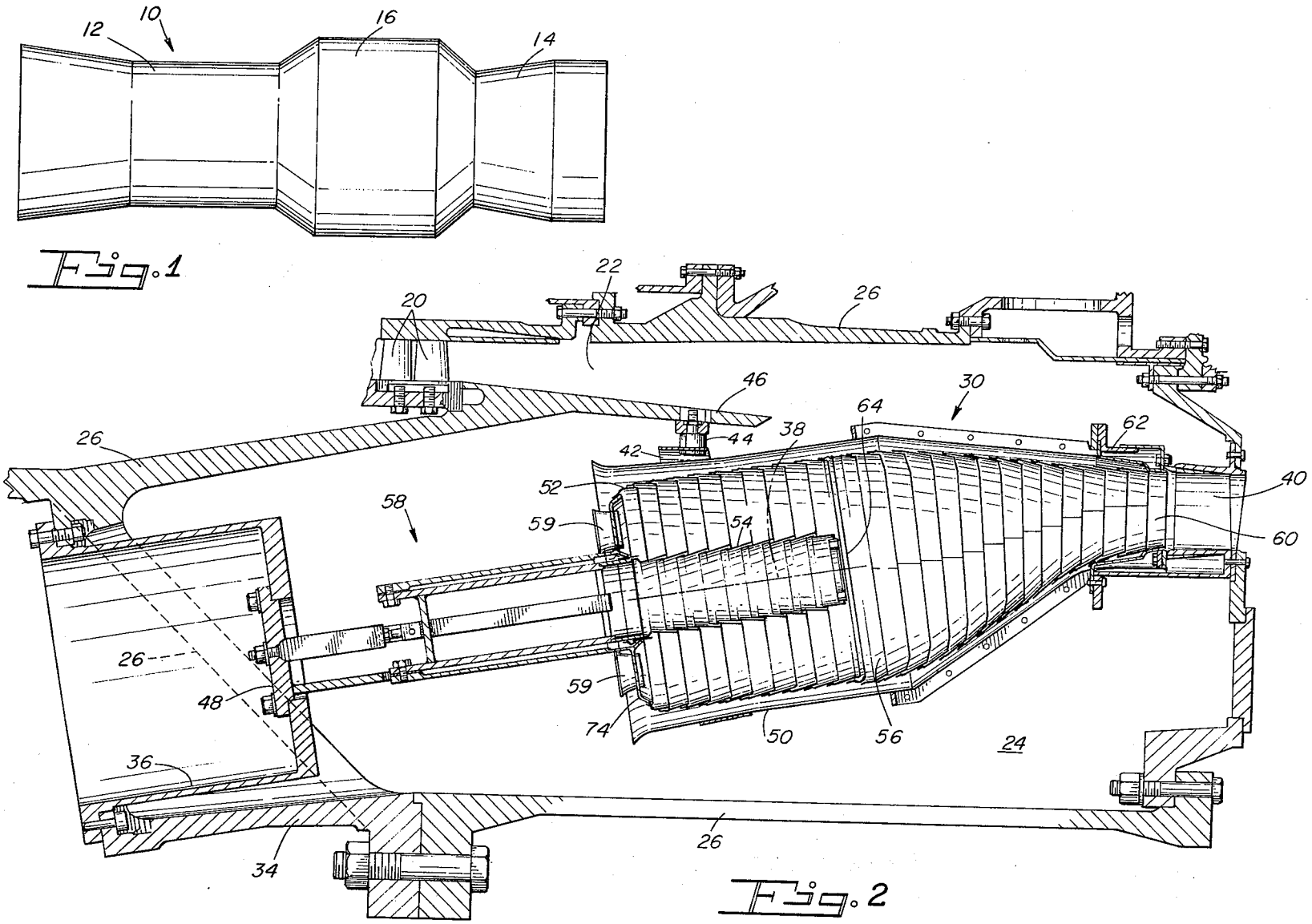
FIG. 1 illustrates the profile of a gas turbine engine in which the novel chamber assembly of the present invention may be employed.
FIG. 2 is a longitudinal, cross-sectional view of the engine showing in detail a fragment of the combustion section between the compressor discharge and turbine inlet and including the combustion chamber assembly of the present invention.

FIG. 1 illustrates a gas turbine engine, generally designated 10, of the axial-flow type which includes a multi-stage compressor section 12, a turbine section 14 and a combustor or combustion section 16. Air is ingested into the compressor at the front end of the engine and flow generally axially through the compressor into the combustion section where it combines with fuel in the combustion process. The combustion gases are then utilized to drive single or multi-stage turbines in the section 14. If the gas turbine engine 10 is a thrust engine, the combustion gases are expelled at high velocity through a diffuser at the rear of the engine. If the engine is a power turbine such as that used in industrial power plants, the combustion gases drive a power turbine connected through a power shaft with an electrical generator or other equipment.

Turning more particularly to the present invention, FIG. 2 illustrates in detail the lower part of the combustion section 16 and its relationship to adjacent portions of the engine. The stator vanes 20 forming the last stage of the compressor 12 are located upstream of a diffuser duct 22 which empties into a large plenum chamber 24 formed within the engine casing 26 at the combustion section. The plenum chamber 24 is an annular chamber circumscribing the engine axis, which is located above the fragment of the combustion section illustrated in FIG. 2, and includes a plurality of circumaxially disposed compartments, each of which houses a combustion chamber assembly, generally designated 30. Air from the compressor passes through the diffuser duct 22 into the plenum chamber 24 and over the combustion chamber assemblies 30. Within the plenum chamber, the air loses much of its turbulence and temporarily reverses its rearward movement through the engine to flow into a forward portion of the plenum chamber defined in part by a dormer 34 in a frustoconical wall portion of the engine casing 26. A dormer 34 is located in alignment with each of the combustion chamber assemblies disposed about the engine axis. Each dormer has a recessed cover 36 bolted into the dormer coaxially of the extended combustion chamber axis 38. Compressor air reaching the dormer portion of the casing 26 becomes more stagnated than that at the exit of the diffuser duct and is in a more quiescent condition for entry into the forward end of the combustion chamber assembly 30. Within the combustion assembly, the air combines with fuel, is burned and the combustion gases then pass rearwardly into the inlet duct 40 of the turbine section (not shown). Thus, it is apparent that the illustrated combustion section has a folded design and that the rearward axial flow of air through the diffuser discharge duct 22 is reversed within the plenum chamber 24 and again with the dormer section of the plenum chamber in order to continue the generally axial movement through the engine from front to rear.

Each of the combustion chamber assemblies 30 is suspended from the engine casing 26 at substantially three points. The rear end of the combustion assembly is connected to the partition supporting the turbine inlet duct 40, part of the midsection of the assembly is suspended from the outer wall 46 of the diffuser duct 22 by means of a belly band 42 and fastener 44 and the forward portion of the assembly is suspended from a removable cover plate 48 fastened by bolts or other suitable means to the cover 36 in the dormer 34.

The combustion chamber assembly is comprised principally of a cooling shroud 50, an outer combustion chamber liner 52, an inner center liner 54, a transition duct 56 connecting the outer liner to the turbine inlet 40 and the forward support structure generally designated 58 connecting the liners 52 and 54 with the cover plate 48. The cooling shroud 50 has a flaired forward end and defines an annular air flow passage between its inner surface and the outside surface of the outer combustion chamber liner 52. Air in the plenum 24 moves into the forward end of the shroud and passes through the annular passage where it enters the outer liner. Air also moves through the support structure 58 and into the open forward end of the inner liner 54 so that the air can pass through the liner 54 into the combustion chamber from the central axis 38.

The liners 52 and 54 are both formed from perforated cylindrical shells and the inner liner 54 is mounted coaxially of the outer liner defining the central combustion chamber axis 38 so that an annular combustion chamber space is defined between the liners. The fuel injection assemblies (not shown) extend from the recessed cover 36 to associated sockets 59 mounted in the forward end wall 74 of the outer liner 52. Burning of the fuel and air is initiated within the annular combustion chamber space adjacent the end wall 74. It is also contemplated such burning may continue into the transition duct 56 after which the combustion gases pass into the turbine inlet duct 40.

It will be readily understood that since burning takes place within the liner 52 and the transition duct 56, these components of the combustion chamber assembly will be subjected to substantially greater thermal expansion than the cooling duct 50 which is bathed in the air discharged from the compressor. Accordingly, the liners 52 and 54 are connected forwardly to the cover plate 48 by the support structure 58, and the outer liner 52 is seated at the rear in a socket formed by the front section 64 of the transition duct 56. The rearward most section 60 of the transition duct 56 is connected by means of a coupling 62 to the turbine inlet duct 40. Only the forward end of the cooling shroud 50 is connected to the diffuser wall 46 by means of the belly band 42 while the rear end of the shroud is connected by the coupling 62 to the turbine inlet 40. With the assemblies supported in this fashion, the outer liner 52 at the center of the assembly may expand radially relative to the cooling shroud without affecting the more rigid attachment of the shroud to the diffuser wall 46 provided by the belly band 42 and fastener 44. Such support for the combustion assembly also permits the liners 52 and 54 together with the support structure 58 and the cover 36 to be removed or installed through the opening in the dormer 34.

Figure 3:
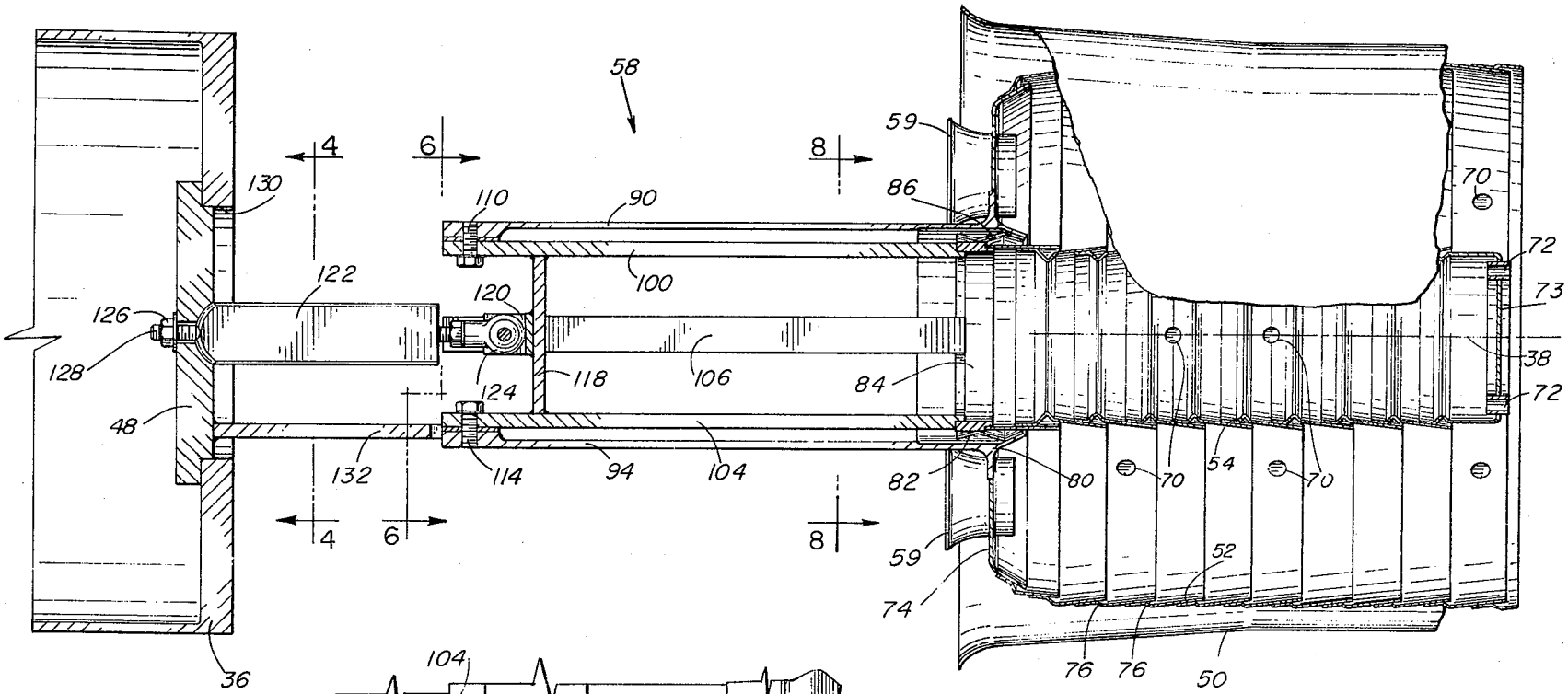
FIG. 3 is an enlarged cross-sectional view of the combustion chamber assembly shown in FIG. 2.

Turning more particularly to the present invention, FIG. 3 shows in greater detail the mounting of the inner liner 54 within the outer liner 52 and the support structure 58 which permits the inner liner to be removed from the engine or installed in the engine independently of the outer liner 52. It will be noted that both of the liners 52 and 54 have a shell structure generated by a series of ring sections which are partially telescoped within one another and welded or otherwise joined together. Combustion holes 70 distributed circumaxially about selected ring sections allow compressor air to enter the combustion space defined between the inner and outer liners. The rearward end of the inner liner 54 has an axial end wall 73 provided with a number of swirlers 72 which also introduce air into the combustion chamber and improve the mixture of fuel and air during the burning process. The opposite axial end of the inner liner 54 is open so that air entering the shroud 50 along the axis 38 of the combustion chamber assembly may pass along the axis and then radially outward from the axis through the inner liner into the annular combustion space.

Figure 8:
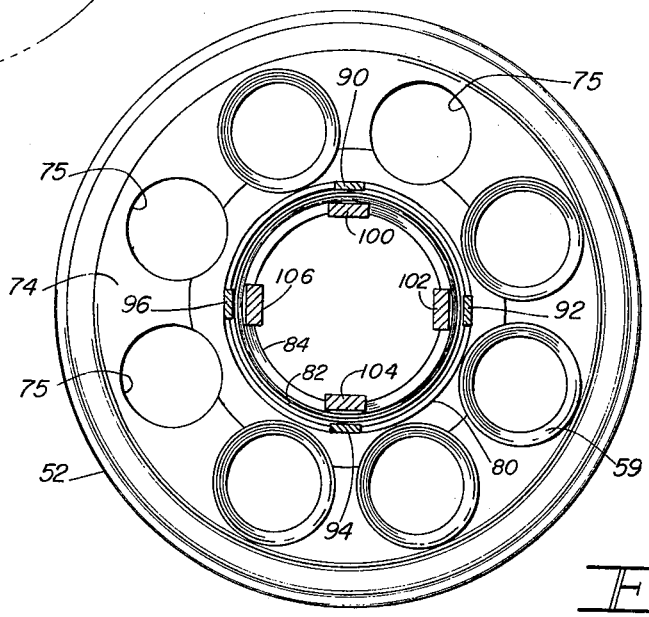
FIG. 8 is another axial cross-section of the support structure and the combustion chamber assembly as viewed along the sectioning line 8—8 in FIG. 3.

The downstream end of the outer liner which fits into the transition duct is open to allow burning gases within the combustion chamber to pass into the transition duct and eventually into the engine turbine. The upstream end of the liner 52 is defined by an end wall 74 containing a plurality of openings 75, illustrated in FIG. 8, for accommodating the sockets 59 into which the fuel injectors project. Not all of the sockets 59 are shown in FIG. 8 in order to illustrate the openings 75.

Each of the ring sections forming the liners 52 and 54 has a plurality of circumaxially spaced cooling apertures 76 near the telescoped portions of the ring sections to allow air to enter the combustion chamber space in a direction generally parallel to the axis of the chamber assembly and to provide some cooling of the liner walls. The cooling air then joins the combustion process with the other air entering through the apertures 70 and the swirlers 72.

Figure 9:
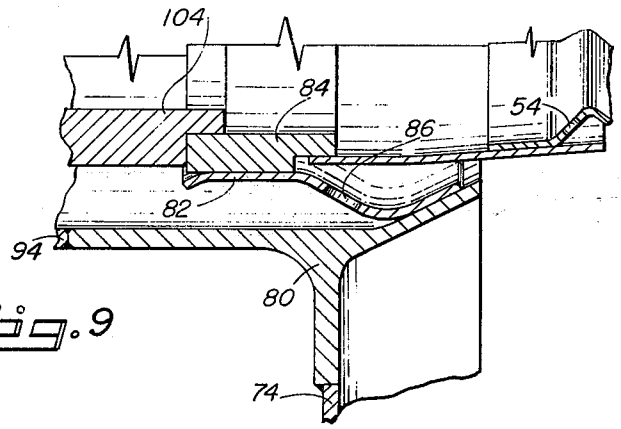
FIG. 9 is a fragmentary detail view of the slip joint between the combustion chamber liners.
Figure 4:
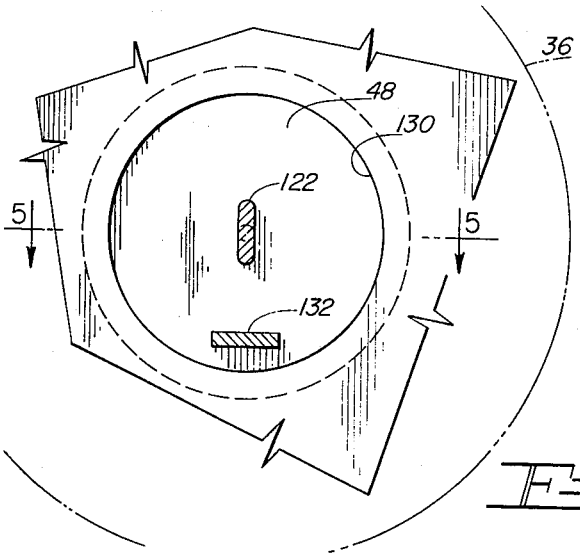
FIG. 4 is an axial cross-section of a support structure for the combustion chamber assembly as viewed along the sectioning line 4—4 of FIG. 3.

The end wall 74 of the outer liner 52 has a central opening in which a reinforcing ring 80 is mounted and welded or otherwise attached to the liner 52. Within the ring 80, a flexible metallic sealing ring 82, shown more clearly in FIG. 9, is welded and this sealing ring mates in close fitting relationship with a reinforcing ring 84 welded or otherwise attached to the adjacent end of the liner 54. The sealing ring 82 is provided with circumaxially spaced cooling apertures 86 similar to the cooling apertures 76 in the liners 52 and 54 to provide cooling for the reinforcing rings 80 and 84.

Additionally, the sealing ring 82, the reinforcing rings 80 and 84 and the ring sections forming the liner 54 are sized to form a slip joint which permits the liner 54 with the ring 84 to be inserted into the liner 52 along the axis 38 to the position shown or to be removed from the liner 52 for inspection, replacement, or repair. Thus, the smallest inside diameter of the ring 80 is larger than the largest outside diameter of the ring sections forming the liner 54. Furthermore, the end wall 74 of the outer liner 52 together with the reinforcing ring 80 supports the inner liner 54 coaxially within the outer liner.

The support structure 58 which connects the inner liner 54 and the outer liner 52 with the cover plate 48 is comprised principally with two sets of support rods, the first set being connected with the outer liner and including rods 90, 92, 94 and 96 and the second set being connected with the inner liner 54 and including rods 100, 102, 104, and 106. The first set of rods extends from the outer lines reinforcing ring 80 connected to the end wall 74 of the outer liner 52 in parallel relationship with an extended part of the combustion chamber axis 38 toward the cover plate 48. The second set of rods 100, 102, 104, 106 connects with the inner liner reinforcing ring 84 attached to the inner liner 54 and extends parallel to the axis 38 and within the respective rods 90, 92, 94, 96 of the first set toward the plate 48. The ends of the rods nearest the cover plate 48 are interconnected in pairs which have severable connections. In particular, the ends of rods 90 and 100 are interconnected by means of a bolt 110 while the rods 92 and 102 are interconnected by a bolt 112 and the rods 94 and 104 are interconnected by the bolt 114. The rods 96 and 106 are interconnected by a bolt 116. The second set of rods connected with the liner 54 are interconnected with each other by a four-legged spider member 118 shown most clearly in FIG. 6 so that when the rod ends are bolted together the spider will hold all of the rods in a rectangular array with the second set of rods 100, 102, 104 and 106 located closer to the extension of the central axis 38 than the first set of rods 90, 92, 94 and 96. It should be noted that the first set of rods are spaced in the rectangular array in such a manner that the inner liner 54 can be pulled out of the outer liner 52 through the array without interference when the connections formed by the bolts 110, 112, 114 and 116 are severed. The second set of rods also holds the inner liner 54 coaxially within the outer liner 52 when the two sets of rods are interconnected.

Figure 5:
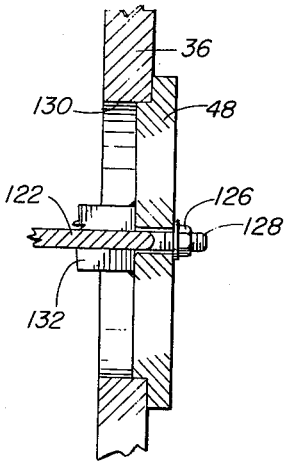
FIG. 5 is a sectional view of the support structure as seen along the sectioning line 5—5 in FIG. 4.
Figure 6:
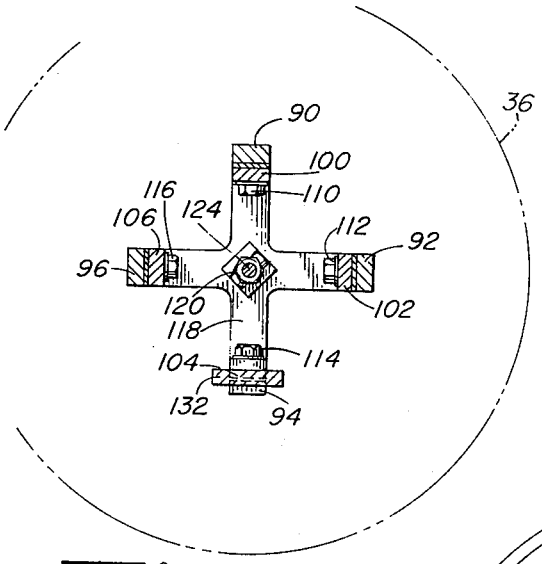
FIG. 6 is another axial cross-section of the support structure as viewed along the sectioning line 6—6 in FIG. 3.

A clevis 120 shown most clearly in FIGS. 3 and 6 is connected to the center of the spider 118 and a connecting link 122 extends between the clevis and the cover plate 48. At the connection with the clevis, the link 122 is provided with a spherical rod end bearing 124 which may be adjusted relative to the rest of the link 122 in order to establish the correct location of the liners 52 and 54 along the axis 38 and within the combustion chamber assembly. The opposite end of the link 122 connecting with the plate 48 fits into a slot in the plate as shown in FIG. 5 which slot prevents the link from turning when a fastening nut 126 is tightened on a stud 128 integrally formed in the end of link 122.

To remove the inner center liner 54 from the combustion chamber assembly when the assembly is installed in the engine casing 26 as in FIGS. 2 and 3, the fastening nut 126 is removed from the stud 128 and the cover plate 48 is removed to open the aperture 130 in the recessed cover 36. Access may then be had to the bolts 110, 112, 114 and 116 interconnecting the first and second sets of support rods. When these bolts are removed, the entire liner 54 together with the rods 100, 102, 104 and 106 can be pulled axially out of the outer liner 52, through the array of rods 90, 92, 94, and 96 and through the aperture 130 in the recessed cover 36 normally closed by the cover plate 48. Accordingly, the aperture 130 is slightly larger than the largest diametral dimension of the second set of support rods, the reinforcing ring 84 or the liner 54.

With the inner liner removed, inspection of the inside of the outer liner 52, the fuel injection nozzles engaging the sockets 59, the transition duct 56 and the first stage turbine blades can be had through the aperture 130. Of course, the inner liner itself may also be inspected once it is removed and, hence, the entire "hot" section of the engine can be inspected without completely disassembling the combustion chamber assembly 30 and without removing the fuel injection assemblies extending between the chamber assembly and the cover 36. It will be understood that the ease of inspection provided by the removable center liner greatly reduces down time for a periodic engine inspection. Also, if there is any damage or deterioration in the inner liner 54, it may be replaced without disassembling the remaining portions of the combustion assembly.

Installation of the center liner after inspection or replacement is accomplished by inserting the liner 54 together with the rods 100, 102, 104, 106 through the aperture 130 and the array of rods 90, 92, 94, 96 until the liner 54 is positioned within the outer liner 52 along the axis 38. The bolts 110, 112, 114 and 116 are then installed in the mating sets of rods by way of the aperture 130. The cover plate 48 is bolted or otherwise fastened in position with the link 122 extending between the clevis 120 and the plate, and the fastening nut 126 is installed and tightened to secure the liners 52 and 54 in position.

Figure 7:
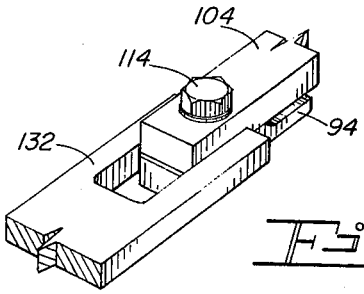
FIG. 7 is a fragmentary perspective view showing an anti-rotation link in the support structure illustrated in FIGS. 3 and 6.

To insure that the liners 52 and 54 are installed within the engine casing with a specified orientation about the axis 38, an alignment and anti-rotation link 132 is fixed to the cover plate 48 and extends into engagement with the support rods 94 and 104 holding the liners. The end of the link 132 and the engagement with the rods is illustrated in greater detail in FIG. 7. The link is bifurcated and the space between the bifurcations corresponds precisely with the lateral width of the rods 94 and 104 so that the rods and the link 132 may be inter-engaged as illustrated. The lateral dimension of the support rods other than rods 94 and 104 is greater than the spacing of the bifurcations so that a unique orientation of the liners about the central axis 38 must be preserved in a removal and replacement operation. The cover 36 and the plate 48 must also be provided with dowels or other suitable indexing means so that the alignment link 132 always assumes the same location within the engine casing.

Accordingly, a unique combustion chamber assembly has been disclosed having a removable inner center liner which allows inspections to be carried out in the hot section of an engine without major disassembly. Additionally, the center liner itself may be replaced without removing other portions of the combustion chamber assembly from its installation in the combustion section of the engine.

Although the present invention has been described in a preferred embodiment, it should be understood that numerous modifications and substitutions may be had without departing from the spirit of the invention. For example, support structure other than the two sets of rods and link 122 may be provided between the cover plate 48 and the liners 52 and 54 provided that the structure allows the liner to be axially removed from the combustion chamber assembly 30. The specific construction of the shells which form the liners may also be varied without affecting the removability of the center liner. Accordingly, the present invention has been described in a preferred embodiment by way of illustration rather than limitation.

We claim:

1. A combustion chamber assembly for a gas turbine engine or the like comprising:

an outer combustion chamber liner formed from a perforated shell and defining a central axis of the combustion chamber, the shell being open at one axial end to dispel burning gases from within the combustion chamber and having at the opposite axial end an end wall bearing a central opening concentric with the central axis and a plurality of circumaxially spaced openings for receiving fuel injection nozzles;

an inner liner formed from a perforated shell extending into the outer liner along the central axis from the central opening in the end wall of the outer liner to admit air into the combustion chamber along the central axis, the perforated shell forming the inner liner being sized to be inserted into and removed from the outer liner through the central opening in the end wall of the outer liner and in the inserted position mating closely with the opening and the end wall of the outer liner to form an annular combustion chamber space adjacent the end wall and between the inner and outer liners, and means to support said inner liner to be removable from within said outer liner without disturbing said outer liner.

2. A combustion chamber assembly for a gas turbine or the like as defined in claim 1 wherein said support means includes:

first support means connected to the perforated shell forming the outer combustion chamber liner, and second support means connected to the perforated shell forming the removable inner liner and having a severable connection with the first support means.

3. A combustion chamber assembly as defined in claim 2 wherein:

the first support means comprises a first set of support rods connected to the end wall of the outer liner at said opposite axial end, the first set of rods being spacially separated from an extended portion of the central axis of the combustion chamber to avoid interference with the inner liner upon insertion and removal through the opening in the end wall of the outer liner.

4. A combustion chamber assembly as in claim 3 wherein:

the second support means comprises a second set of support rods connected to the removable inner liner and located closer to the extended portion of the central axis of the combustion chamber than the first set of support rods.

5. The combustion chamber assembly of claim 4 wherein:

the first and second sets of support rods are severably interconnected at their ends opposite their respective connections with the inner and outer liners.

6. The combustion chamber assembly of claim 1 wherein:

the inner and outer liners are both formed from perforated cylindrical shells.

7. A combustion chamber interposed between a compressor and turbine of a gas turbine engine comprising:

a combustion assembly having an outer liner defining a combustion chamber having a central axis, said outer liner having an end wall with an opening defined therein, and a coaxial inner center liner projecting into the chamber from the end wall of the outer liner along the central axis, said inner liner being shaped and sized to be smaller than and passable through said opening;

means to support said liners so that said inner liner is insertable into and removable from within said outer liner through said opening without disturbing said outer liner; and an engine casing defining at least one compartment for receiving compressor discharge air and for housing the combustion chamber assembly and having a removable wall portion to permit removal and insertion of the inner liner of the assembly through the engine casing.

8. A combustion section as defined in claim 7 wherein:

the removable wall portion of the engine casing comprises a plate located at a station on the casing aligned with the axis of the combustion chamber and sized to accommodate the inner liner.

9. A combustion section as defined in claim 7 wherein:

the inner and outer liners are generally cylindrical in shape and define an annular combustion space adjacent the end wall.

10. A combustion section of a gas turbine as defined in claim 7 wherein:

the inner liner is supported at least in part along the central axis by the end wall of the outer liner.

11. A combustion section as defined in claim 10 further including severable support means connecting the inner and outer liners with the removable wall portion of the engine casing.

* * * * *

UNITED STATES PATENT OFFICE

CERTIFICATE OF CORRECTION

PATENT NO. : 3,991,562

DATED : November 16, 1976

INVENTOR(S) : James C. Nelson
Bertus Ooms

It is certified that error appears in the above-identified patent and that said Letters Patent are hereby corrected as shown below:

| | | |
|---|---|---|
| Column 2, | line 16 | After "novel" insert --combustion-- |
| | line 27 | Delete "of" and insert --in-- |
| | line 47 | Delete "flow" and insert - flows-- |

Signed and Sealed this

Tenth Day of May 1977

[SEAL]

*Attest:*

RUTH C. MASON
*Attesting Officer*

C. MARSHALL DANN
*Commissioner of Patents and Trademarks*